US007527210B2

(12) United States Patent
Ricco et al.

(10) Patent No.: US 7,527,210 B2
(45) Date of Patent: May 5, 2009

(54) FUEL INJECTOR FOR AN INTERNAL-COMBUSTION ENGINE

(75) Inventors: Mario Ricco, Casamassima (IT); Adriano Gorgoglione, Valenzano (IT); Onofrio De Michele, Valenzano (IT); Domenico Lepore, Valenzano (IT)

(73) Assignee: C.R.F. Societa Consortile per Azioni, Orbassano (IT)

( * ) Notice: Subject to any disclaimer, the term of this patent is extended or adjusted under 35 U.S.C. 154(b) by 141 days.

(21) Appl. No.: 11/616,695

(22) Filed: Dec. 27, 2006

(65) Prior Publication Data

US 2007/0240682 A1 Oct. 18, 2007

(30) Foreign Application Priority Data

Apr. 13, 2006 (EP) ..... 06425265

(51) Int. Cl.
*F02M 41/16* (2006.01)
*B05B 1/30* (2006.01)

(52) U.S. Cl. ..... 239/96; 239/585.5; 239/533.9

(58) Field of Classification Search ..... 239/88–92, 239/96, 533.2, 533.9, 533.11, 533.12, 584, 239/585.1, 585.3, 585.4, 585.5; 251/129.15, 251/129.21, 127

See application file for complete search history.

(56) References Cited

U.S. PATENT DOCUMENTS

| | | | | |
|---|---|---|---|---|
| 5,544,816 | A * | 8/1996 | Nally et al. | 239/585.5 |
| 5,692,723 | A * | 12/1997 | Baxter et al. | 251/129.21 |
| 5,921,475 | A * | 7/1999 | DeVriese et al. | 239/585.4 |
| 6,520,150 | B1 * | 2/2003 | West | 123/446 |
| 6,808,125 | B2 | 10/2004 | Ruthardt et al. | 239/89 |
| 7,059,301 | B2 * | 6/2006 | Stockner et al. | 123/446 |
| 2005/0178859 | A1 | 8/2005 | Sako | 239/533.9 |

FOREIGN PATENT DOCUMENTS

| | | |
|---|---|---|
| DE | 10148861 | 4/2003 |
| EP | 1081372 A2 | 3/2001 |

* cited by examiner

*Primary Examiner*—Davis Hwu
(74) *Attorney, Agent, or Firm*—Seed IP Law Group PLLC

(57) ABSTRACT

The fuel injector comprises a hollow casing, fixed on which is a nozzle having a nebulizer for the fuel under pressure, a needle axially mobile for opening and closing the nebulizer by means of a first end thereof, and a control rod, substantially coaxial with the needle and in direct engagement therewith. The needle is normally pushed into a closing position of the nozzle by the fuel under pressure acting on the rod, aided by a compression spring, which acts on the needle through a sleeve that is in axial engagement with a portion of the rod. The sleeve further comprises a surface designed to engage at the front and directly one end of the needle. The spring engages another surface of the sleeve so as to transmit its action directly onto the needle.

12 Claims, 1 Drawing Sheet

FUEL INJECTOR FOR AN INTERNAL-COMBUSTION ENGINE

BACKGROUND OF THE INVENTION

1. Field of the Invention

The present invention relates to a fuel injector for an internal-combustion engine. In particular, the invention relates to an injector comprising a casing, fixed on which is a nebulizer having a nozzle for the fuel under pressure, an axially mobile needle for opening and closing the nozzle by means of a first end thereof, and a rod for controlling the needle, which is controlled by the fuel under pressure, aided by a compression spring.

2. Description of the Related Art

As is known, the control rod is substantially coaxial with the needle, which is normally pushed into a closing position of the nozzle by the fuel under pressure in a control chamber, associated to a metering solenoid valve. The compression spring is set in a cavity of the casing and acts on the needle in general through a washer or other element for adjustment of the lift of the needle and/or of the pre-loading of the spring. Furthermore, in general, set between the rod and the needle is an intermediate element, which is provided in classes, such as to enable adjustment of the total axial dimensions of the ensemble formed by the needle, the intermediate element and the rod. The intermediate element presents the drawback of generally causing a certain transverse component of the action of the rod on the needle, which leads to an irregular wear and hence a faster deterioration of the injector. In order to limit this drawback, generally the intermediate element must be made with very high precision, which consequently renders it relatively costly and complex to provide.

In a known injector, the needle has a second end having a conical depression, on which the rod acts. In order to guarantee a perfectly axial resultant of the mutual action of the second end of the needle by the rod, the conical depression of the needle is engaged through an intermediate ball. In a variant of this injector, the conical depression of the needle is engaged directly by one end of the rod, which is shaped so as to guarantee a perfectly axial resultant of the mutual action. This known injector is relatively costly to produce, also on account of the conformation of the two engagement ends and of the shims for the spring.

BRIEF SUMMARY OF THE INVENTION

The aim of the invention is to provide a fuel injector that will present high reliability and a limited cost, and provide better performance of fuel injectors according to the known art.

According to the invention, the above aim is achieved by a fuel injector for an internal-combustion engine, as claimed herein.

In particular, the spring acts on the needle through a perforated intermediate member axially engaging with a portion adjacent to the end of the rod and are formed by a bushing having an area or surface of engagement with the needle with an external diameter that is smaller than or equal to that of the needle.

BRIEF DESCRIPTION OF THE SEVERAL VIEWS OF THE DRAWINGS

For a better understanding of the invention a preferred embodiment is described herein by way of example with the aid of the annexed drawings, wherein.

DETAILED DESCRIPTION OF THE INVENTION

Figure 1:
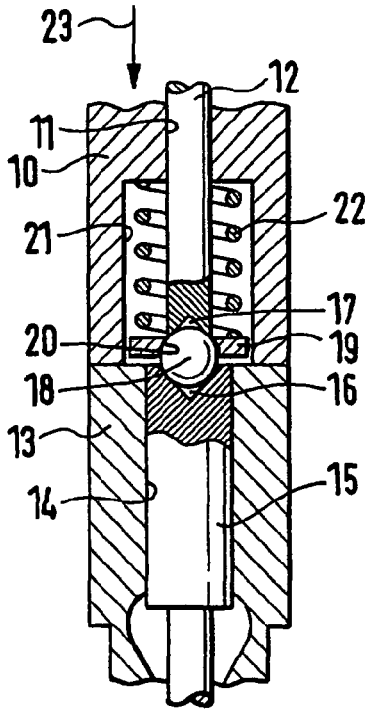
FIG. 1 is an axial section of a fuel injector according to the invention.

With reference to FIG. 1, number 1 designates as a whole a fuel injector for an internal-combustion engine, in particular for a diesel engine (not illustrated). The injector 1 comprises an external hollow casing 2, which extends along an axis 3 and has a side inlet 5, designed to be supplied with fuel at a high pressure. The injector 1 further comprises a terminal nebulizer 7, for injecting the fuel into a corresponding cylinder of the engine. Normally, the nebulizer 7 is kept closed by a conical end 8 of a shutter needle 9.

In particular, the nebulizer 7 is carried by a body, referred to hereinafter as nozzle 10, which is coaxial with respect to the casing 2 and is fixed in a known way to a portion 11 of the casing 2 itself. Another portion 12 of the casing 2 is set on the opposite side with respect to the nozzle 10 and houses an electromagnetically controlled metering valve 13, of a known type and not described in detail. The valve 13 has an outlet 14 for sending, towards the usual fuel tank (not illustrated), the fuel discharged by the valve 13 itself and the part of fuel that leaks through the internal components of the injector 1.

The nozzle 10 carries a cylindrical axial compartment 16, which comprises a cylindrical hole 17, axially guided in which is, in a fluid-tight way, a portion 18 of the needle 9, which hence shares the axis 3. The compartment 16 is engaged by a second portion 19 of the needle 9, which terminates with the end 8 and has a diameter slightly smaller than that of the portion 18. Defined between the portion 19 and the wall of the axial compartment 16 is a channel 20, which, on one side, gives out into the nebulizer 7 and on the other is in communication with the inlet 5, through a pipe 21 and an annular injection chamber 22.

The injector 1 further comprises an axial control rod 23, which, under the control of the valve 13, is designed to slide in a compartment 24 of the portion 11 of the casing 2, which also shares the axis 3. In particular, the valve 13 comprises a valve body 25 fixed to the body 2 of the injector 1, which is provided with an axial hole 26, guided in which is, in a fluid-tight way, a portion 27 of the rod 23. The portion 27 terminates at the top with a surface 28 that defines a control chamber 29. The chamber 29 is in communication with the inlet 5 for the fuel via a calibrated inlet hole 30 and with the outlet 14 via a calibrated discharge hole 31. The latter is normally kept closed by a shutter 32 controlled in a known way by an electromagnet 33.

The rod 23 is provided with one end 34 opposite to the surface 28, which is designed to act on a second end 35 of the needle 9 opposite to the conical end 8. The rod 23 is thus subjected to the opposite axial thrusts of the pressure of the fuel present in the injection chamber 22 on the needle 9 and of the pressure of the fuel present in the control chamber 29. Normally, with the valve 13 closed, the pressure of the fuel on the rod 23 prevails over the pressure on the needle 9 so that the nebulizer 7 is kept closed.

Furthermore, the compartment 24 of the portion 11 of the casing 2 comprises a bottom portion 36 having a larger diameter, which forms an annular shoulder 37. The rod 23 is provided with a portion 38 adjacent to the end 34, set around which is a compression spring 39 housed in the portion 36 of the compartment 24 and designed to contribute to carrying the needle 9 into a closing position, as will be seen in greater detail in what follows.

Figure 2:
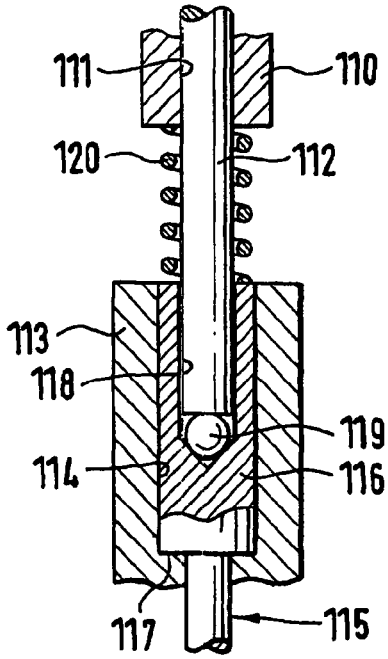
FIG. 2 is a part of FIG. 1 at an enlarged scale.

According to the invention, the spring 39 acts on the needle 9 through perforated intermediate means, designated as a whole by 40, which are in axial engagement with the portion 38 of the rod 23, the end 34 of which is designed to engage directly and at the front the second end 35 (see also FIG. 2) of the needle 9, adjacent to the portion 18. In particular, the end 34 of the rod 23 and the end 35 of the needle 9 are represented by two corresponding front surfaces, which are in contact with one another. Preferably, the end 34 of the rod 23 has an arched shaped or is shaped like a spherical cap, whilst the end 35 of the needle 9 is preferably plane.

The perforated intermediate means 40 comprise an area 43, which is able to slide axially, with a certain amount of play, in the portion 36 of the compartment 16. Furthermore, the intermediate means 40 comprise an area 44 having an external diameter smaller than that of the area 43 and smaller than the diameter of the portion 18 of the needle 9. In this way, any possible displacement of the area 43 in the portion 17 of the compartment 16 of the nozzle 10 is allowed, in the case where the end 35 of the needle 9 were to be inside the portion 17 itself, ensuring that the load of the spring 39 will be transmitted only to the needle 9 excluding the nozzle 10 from said load.

The two areas 43 and 44 each have an axial hole 45 of a diameter corresponding to the diameter of the portion 38 of the rod 23 so that the means 40 are guided axially by the portion 38 of the rod 23 through said hole 45. The portion 38 has a diameter smaller than that of the portion 18 of the needle 9 so that also the end 34 of the rod 23 has a diameter smaller than that of the end 35 of the needle 9. According to the variant of FIGS. 1 and 2, the two areas 43 and 44 are made of a single piece and form a single bushing 40. The two areas 43 and 44 are cylindrical and have two external annular, plane, surfaces 47 and 48, which are opposite and perfectly parallel to one another. The two areas 43 and 44 form between them an annular shoulder 49, which is also external. The compression spring 39 can act directly on the plane surface 47 of the bushing 40, whilst the plane surface 48 is designed to act directly against an annular portion of the end or surface 35 of the needle 9.

In use, when the electromagnet 33 causes opening of the metering valve 13, the pressure in the control chamber 29 drops rapidly so that the pressure in the injection chamber 22 acting on the needle 9 prevails over the resultant of the reduced pressure acting on the rod 23 and of the spring 39 acting on the bushing 40. The needle 9 is hence displaced upwards thus opening the nebulizer 7 and compressing the spring 39 against the shoulder 37 of the compartment 16. When then the electromagnet 33 is no longer energized and the shutter 32 closes under the action of elastic contrast means, in themselves known, the pressure of the fuel in the control chamber 29 is restored so that, on the one hand, the end 34 of the rod 23 pushes the needle 9 towards the nebulizer 7 and, on the other hand, the spring 39 acts on the bushing 40, which, by means of its surface 48, contributes to the thrust of the needle 9 in the direction of the nebulizer 7.

Figure 3:
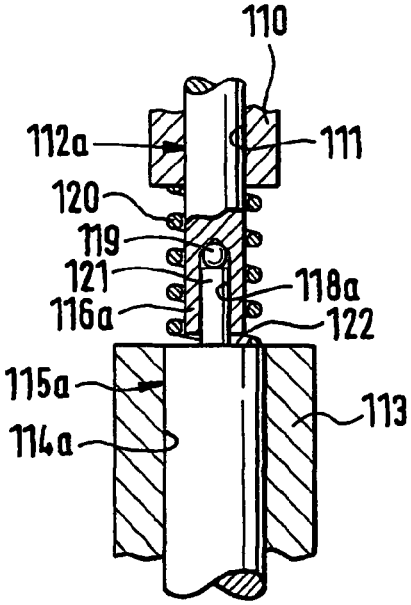
FIGS. 3 and 4 are two sections of two variants of a detail of FIG. 2.

According to the variant of FIG. 3, the two areas 43*a* and 44*a* also form a single bushing 40*a*, but the area 44*a* has the shape of a truncated cone instead of being cylindrical. The surface 48 of the area 44*a* acts also against the end 35 of the needle 9 (see also FIG. 2), but its external diameter and the angle of opening of the conical area 44*a* are such that, when the needle 9 is in the position for closing the nebulizer 7, the external surface shaped like a truncated cone of the area 44*a* will not touch the edge of the cylindrical hole 17 of the nozzle 10.

Figure 4:
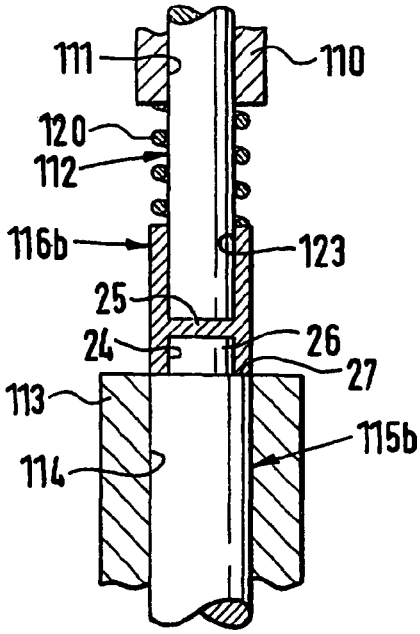

According to the variant of FIG. 4, the intermediate means 40*b* comprise two areas formed by two separate bushings 43*b* and 44*b*, which both have cylindrical external lateral surfaces. In this case, the two plane surfaces in contact with the two bushings 43*b* and 44*b* must be machined with a precision sufficient to guarantee the parallelism of the two external plane surfaces 47 and 48.

From the above description, it is evident that, in all the variants described of the intermediate means 40, 40*a*, 40*b*, the surfaces 47 and 48 are external to the hole 45 and are hence in sight. In particular, they are without any projection in the bottom area so that machining thereof is simpler and more precise. Furthermore, there is no need to have any adjustable element between the spring 39 and the intermediate means 40, 40*a* and 40*b* nor a resting element between the spring 39 itself and the shoulder 37. However, such an adjustment or resting element does not modify operation of the injector 1.

It is understood that various modifications and improvements can be made to the injector described herein without departing from the scope of the claims. For example, the surfaces of contact of the ends 34, 35 of the rod 23 and of the needle 9 can both be plane or curved in a complementary way. In turn, the bushing 40 of FIG. 2 can be provided with a groove made between the shoulder 49 and the external lateral surface of the area 44, for example, for machining requirements. It is moreover possible to provide between the cylindrical areas 43 and 44 a linked area of transition different from the conical one. The external surface of the area 44*a* of the bushing 40*a* can also be shaped differently, or the areas 43*a* and 44*a* can be englobed in a single conical surface between the plane surfaces 47 and 48. Also the external surface of the bushing 44*b* can be conical or with a shaped profile. Finally, the bushing 40 can have a constant diameter, whereas the portion 18 of the nozzle 9 can be provided with an undercut for enabling its displacement, or else said portion 18 can have a length such that its end 35 will remain always outside the hole 17.

All of the above U.S. patents, U.S. patent application publications, U.S. patent applications, foreign patents, foreign patent applications and non-patent publications referred to in this specification and/or listed in the Application Data Sheet, are incorporated herein by reference, in their entirety.

From the foregoing it will be appreciated that, although specific embodiments of the invention have been described herein for purposes of illustration, various modifications may be made without deviating from the spirit and scope of the invention. Accordingly, the invention is not limited except as by the appended claims.

The invention claimed is:

1. A fuel injector for an internal-combustion engine, comprising:

a hollow casing, fixed on which is a nozzle having a nebulizer for the fuel under pressure;

an axially mobile needle for opening and closing said nebulizer by a first end thereof; and a rod for controlling said needle, said rod being substantially coaxial with said needle and engaging with one end thereof a second end of said needle, said needle being normally pushed into a closing position of said nebulizer by the fuel under pressure acting on said rod, aided by a compression spring, said spring acting on said needle through a perforated intermediate member, which is in axial engagement with a portion of said rod adjacent to said one end of said rod, said intermediate member having a first region designed to engage at a front portion and directly said second end of said needle, said intermediate member also having a second region at a rear portion, the second region having an external diameter greater than an external diameter of the first region, said spring engaging said second region in such a way that said intermediate member transmits the corresponding action directly onto the second end of said needle.

2. The injector according to claim 1, wherein said intermediate member is defined by two surfaces that are plane, parallel and external or in sight.

3. The injector according to claim 1, wherein said first region has an external diameter smaller than or equal to the diameter of said second end of said needle.

4. The injector according to claim 1 wherein said portion of said rod adjacent to said one end of the rod has a diameter smaller than the diameter of said second end.

5. The injector according to claim 1 wherein said spring is set in a portion of an axial compartment of said casing, said second region being defined by a cylindrical element that is mobile along said portion of the axial compartment.

6. The injector according to claim 5 wherein the axial compartment of said casing is provided with an annular surface of contrast for said spring, at least one modular adjustment element being set between said surface of contrast and said end of the needle to enable calibration of pre-loading of said spring.

7. The injector according to claim 5 wherein the axial compartment of said casing is provided with an annular surface of contrast for said spring, said intermediate member comprising at least one region having a modular thickness to enable calibration of the pre-loading of said spring.

8. The injector according to claim 1 wherein said first and second regions are defined by a single bushing and have two cylindrical external surfaces, said bushing being provided with an axial hole by means of which it is guided by said portion of said rod adjacent to said one end of the rod.

9. The injector according to claim 1 wherein said first and second regions are carried by two coaxial bushings, which have cylindrical external surfaces, said coaxial bushings being provided with two axial holes of equal diameter, by means of which they are guided by said portion of said rod adjacent to said one end of the rod.

10. The injector according to claim 1 wherein said first and second regions are defined by a single bushing, one of said first and second regions having a cylindrical external surface, said bushing being provided with an axial hole, by means of which it is guided by said portion of said rod adjacent to said one end of the rod.

11. The injector according to claim 1 wherein the other of said first and second regions has an external surface having the shape of a truncated cone or being otherwise shaped.

12. The injector according to claim 1 wherein said first and second regions are defined by a single bushing integrated in a single cylindrical lateral external surface, having the shape of a truncated cone or being otherwise shaped, set between said external surfaces, said single bushing being provided with an axial hole by means of which it is guided by said portion of said rod adjacent to said one end of the rod.

* * * * *

UNITED STATES PATENT AND TRADEMARK OFFICE

CERTIFICATE OF CORRECTION

PATENT NO. : 7,527,210 B2
APPLICATION NO. : 11/616695
DATED : May 5, 2009
INVENTOR(S) : Mario Ricco et al.

It is certified that error appears in the above-identified patent and that said Letters Patent is hereby corrected as shown below:

The title page should be deleted and substitute therefor the attached title page.

Drawings:

Delete drawing sheets 1-4 and substitute therefor the drawing sheets, consisting of figs. 1-4 as shown on the attached page.

Signed and Sealed this

Twentieth Day of October, 2009

David J. Kappos

David J. Kappos
*Director of the United States Patent and Trademark Office*

(12) United States Patent
Ricco et al.

(10) Patent No.: US 7,527,210 B2
(45) Date of Patent: May 5, 2009

(54) FUEL INJECTOR FOR AN INTERNAL-COMBUSTION ENGINE

(75) Inventors: Mario Ricco, Casamassima (IT); Adriano Gorgoglione, Valenzano (IT); Onofrio De Michele, Valenzano (IT); Domenico Lepore, Valenzano (IT)

(73) Assignee: C.R.F. Societa Consortile per Azioni, Orbassano (IT)

( * ) Notice: Subject to any disclaimer, the term of this patent is extended or adjusted under 35 U.S.C. 154(b) by 141 days.

(21) Appl. No.: 11/616,695

(22) Filed: Dec. 27, 2006

(65) Prior Publication Data

US 2007/0240682 A1 Oct. 18, 2007

(30) Foreign Application Priority Data

Apr. 13, 2006 (EP) ..... 06425265

(51) Int. Cl.
*F02M 41/16* (2006.01)
*B05B 1/30* (2006.01)

(52) U.S. Cl. ..... 239/96; 239/585.5; 239/533.9

(58) Field of Classification Search ..... 239/88–92, 239/96, 533.2, 533.9, 533.11, 533.12, 584, 239/585.1, 585.3, 585.4, 585.5; 251/129.15, 251/129.21, 127

See application file for complete search history.

(56) References Cited

U.S. PATENT DOCUMENTS

| | | | | |
|---|---|---|---|---|
| 5,544,816 | A * | 8/1996 | Nally et al. | 239/585.5 |
| 5,692,723 | A * | 12/1997 | Baxter et al. | 251/129.21 |
| 5,921,475 | A * | 7/1999 | DeVriese et al. | 239/585.4 |
| 6,520,150 | B1 * | 2/2003 | West | 123/446 |
| 6,808,125 | B2 | 10/2004 | Ruthardt et al. | 239/89 |
| 7,059,301 | B2 * | 6/2006 | Stockner et al. | 123/446 |
| 2005/0178859 | A1 | 8/2005 | Sako | 239/533.9 |

FOREIGN PATENT DOCUMENTS

| | | |
|---|---|---|
| DE | 10148861 | 4/2003 |
| EP | 1081372 A2 | 3/2001 |

* cited by examiner

*Primary Examiner*—Davis Hwu
(74) *Attorney, Agent, or Firm*—Seed IP Law Group PLLC

(57) ABSTRACT

The fuel injector comprises a hollow casing, fixed on which is a nozzle having a nebulizer for the fuel under pressure, a needle axially mobile for opening and closing the nebulizer by means of a first end thereof, and a control rod, substantially coaxial with the needle and in direct engagement therewith. The needle is normally pushed into a closing position of the nozzle by the fuel under pressure acting on the rod, aided by a compression spring, which acts on the needle through a sleeve that is in axial engagement with a portion of the rod. The sleeve further comprises a surface designed to engage at the front and directly one end of the needle. The spring engages another surface of the sleeve so as to transmit its action directly onto the needle.

12 Claims, 1 Drawing Sheet

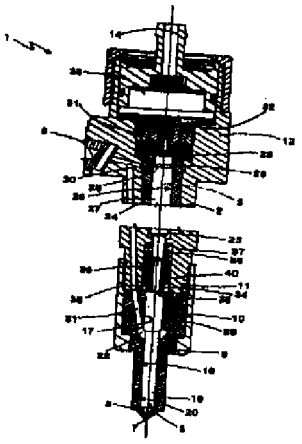

UNITED STATES PATENT AND TRADEMARK OFFICE

CERTIFICATE OF CORRECTION

PATENT NO. : 7,527,210 B2 
APPLICATION NO. : 11/616695
DATED : May 5, 2009
INVENTOR(S) : Mario Ricco et al.

It is certified that error appears in the above-identified patent and that said Letters Patent is hereby corrected as shown below:

Drawings

"

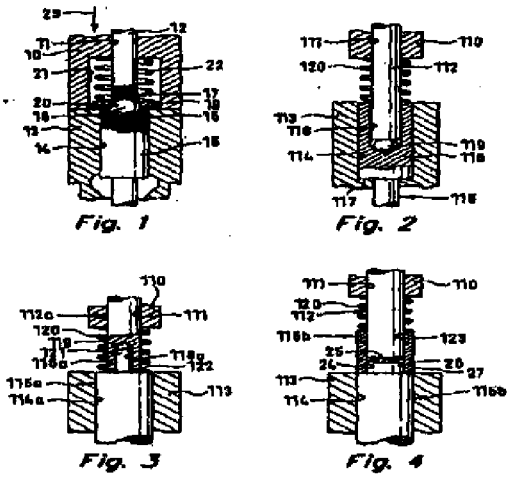

"

should read as

--

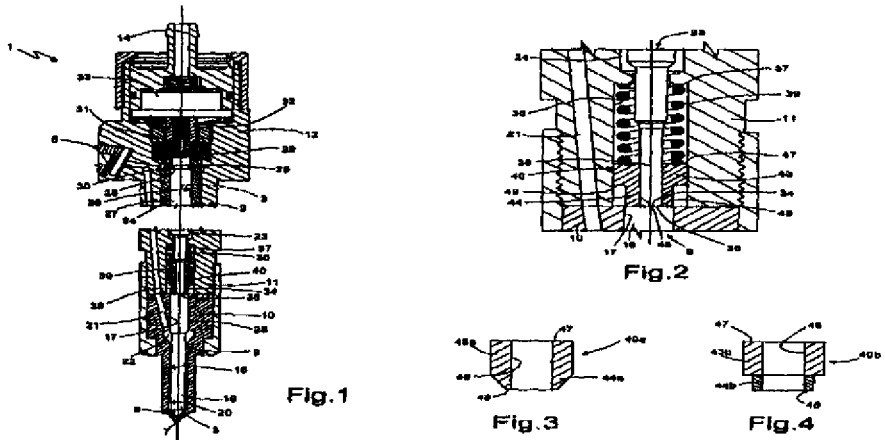

--.